US005228562A

United States Patent [19]

Burk

[11] Patent Number: 5,228,562

[45] Date of Patent: Jul. 20, 1993

[54] MEMBRANE SWITCH AND FABRICATION METHOD

[75] Inventor: Alan M. Burk, Kirkland, Wash.

[73] Assignee: GM Nameplate, Inc., Seattle, Wash.

[21] Appl. No.: 756,909

[22] Filed: Sep. 9, 1991

[51] Int. Cl.[5] ..... H01H 1/10

[52] U.S. Cl. ..... 200/512; 200/514; 200/515; 341/22; 341/34

[58] Field of Search ..... 200/512, 514, 515; 341/22, 34

[56] References Cited

U.S. PATENT DOCUMENTS

| | | | |
|---|---|---|---|
| 3,522,664 | 8/1970 | Lambright et al. . | |
| 3,735,023 | 5/1973 | Hurst et al. . | |
| 3,911,215 | 10/1975 | Hurst et al. . | |
| 4,018,989 | 4/1977 | Snyder et al. . | |
| 4,071,689 | 1/1978 | Talmage et al. . | |
| 4,143,253 | 3/1979 | Wagner et al. | 200/514 X |
| 4,198,539 | 4/1980 | Pepper, Jr. . | |
| 4,220,815 | 9/1980 | Gibson et al. . | |
| 4,371,345 | 2/1983 | Palmer et al. . | |
| 4,373,282 | 2/1983 | Wragg . | |
| 4,423,299 | 12/1983 | Gurol et al. . | |
| 4,476,463 | 10/1984 | Ng et al. . | |
| 4,625,075 | 11/1986 | Jaeger . | |
| 4,661,655 | 4/1987 | Gibson et al. . | |
| 4,672,153 | 6/1987 | Kikuchi . | |
| 4,696,860 | 9/1987 | Epperson . | |
| 4,731,508 | 3/1988 | Gibson et al. . | |
| 4,801,767 | 1/1989 | Sato et al. . | |
| 4,818,827 | 4/1989 | Iplinski et al. | 200/512 X |
| 4,897,511 | 1/1990 | Itaya et al. . | |
| 4,958,148 | 9/1990 | Olson . | |
| 4,977,397 | 12/1990 | Kuo et al. . | |
| 5,072,077 | 12/1991 | Klein | 200/512 X |
| 5,120,912 | 6/1992 | Sharp | 200/512 X |

FOREIGN PATENT DOCUMENTS

| | | | |
|---|---|---|---|
| 2100517 | 12/1982 | United Kingdom | 200/512 |

OTHER PUBLICATIONS

"Melinex Polyester Films" Data Sheet, ICI Films, Wilmington, Del.

"Scotch 9703 Conductive Adhesive Transfer Tape" Data Sheet, 3M, St. Paul, Minn.

*Primary Examiner*—Allan N. Shoap
*Assistant Examiner*—Paul A. Schwarz
*Attorney, Agent, or Firm*—Christensen, O'Connor, Johnson & Kindness

[57] ABSTRACT

A membrane switch (10) having a top membrane (12) with a lower conductive surface (16), a bottom membrane (14) with an upper conductive surface (18), and a dielectric intermediate circuit spacer (20) disposed therebetween. The intermediate circuit spacer includes a central aperture (24) and defines upper and lower surfaces (28 and 32). First y-axis electrodes (26) are formed on the upper surface of the intermediate circuit spacer, and second x-axis (30) electrodes are formed on the lower surface of the intermediate circuit spacer. Conductive adhesive (58, 64) is applied between the intermediate circuit spacer and the top and bottom membranes to secure the intermediate spacer in place with the x- and y-axis electrodes in electrical contact with the top and bottom membranes, respectively.

17 Claims, 6 Drawing Sheets

MEMBRANE SWITCH AND FABRICATION METHOD

TECHNICAL FIELD OF THE INVENTION

The present invention relates to two-dimensional coordinate location devices, and more particularly to membrane switches, and more particularly to analog and digital touch sensitive membrane switches and methods for fabricating the same.

BACKGROUND OF THE INVENTION

Touch sensitive membrane switches have been incorporated into many electronic devices to enable operators to provide instructions to the device by selecting a corresponding horizontal and vertical coordinate location on the membrane switch. For example, membrane switches are often installed over the viewing screen of a cathode ray tube. The user of a device including such a "touch screen" is able to operate the device by pointing to and depressing a particular location on the screen corresponding to a desired menu selection. The touch screen then generates a voltage signal corresponding to the horizontal ("x") and vertical ("y") coordinates of that location. For such an application, the layers used to fabricate the membrane switch are transparent.

Other conventional applications for membrane switches are numeric and function keypads on diverse electronic items, such as microwaves, television sets, calculators, medical instrumentation, and various other devices. Membrane switches may be designed for manual finger or stylus depression for operation. The range of applications for membrane switches is ever increasing, as is the need for producing low cost membrane switches.

One type of conventional membrane switch, often used for touch sensitive screens, is the analog membrane switch. The membrane switch comprises a sandwich of top and bottom membranes with at least the top membrane being made from a flexible material. More typically, both membranes are made from flexible dielectric sheets. One surface of each membrane is coated with a semiconductive resistive layer, such as indium tin oxide ("ITO"), or a conductive layer such as gold.

To construct such a conventional analog membrane switch, top and bottom membrane sheets are etched to form an uncoated, dielectric border surrounding a semiconductive rectangle. Next, electrodes are applied to each of the top and bottom membranes, typically by silk-screening with a conductive ink. On the bottom membrane, two opposing parallel electrode strips are applied across first and second parallel edges of the semiconductive rectangle. On the top membrane, two opposing parallel electrode strips are applied across third and fourth parallel edges of the semiconductive rectangle. The electrodes on the top membrane are thus disposed perpendicular to the electrodes on the bottom membrane.

A layer of a dielectric material, such as an acrylic, is then applied over the top of the electrodes on each membrane. This prevents each set of electrodes from contacting the semiconductive rectangle or leads on the opposing membrane. A random or fixed array of small raised dielectric projections is then applied to the conductive-coated rectangle of the bottom membrane. Finally, the top and bottom membranes are cut, typically by die stamping, to remove excess sheet from around the electrode strips.

The top and bottom membranes are then assembled by superimposing the top membrane over the bottom membrane, with the conductive surfaces facing each other. An adhesive is applied between the borders of the membranes. The top and bottom membranes are normally maintained separate because of the presence of the array of dielectric projections. However, when the top membrane is depressed, it contacts the bottom membrane between the projections. The x and y coordinate locations of this point of depression can be obtained by monitoring voltage drops across the electrodes. Typically, a uniform potential, such as 5 volts, is first applied across a first set of electrodes formed on one of the membranes while the voltage drop across the second set of electrodes on the other membrane is monitored. This voltage corresponds to the horizontal, or "x" coordinate of the depression pointer. This arrangement is then switched, with a potential applied across the second set of electrodes and the voltage drop across the first set of electrodes being monitored to determine the vertical, or "y" coordinate. Monitoring of first and second sets of electrodes oscillates in this manner so that both the x and y coordinate of a depression point can be rapidly measured when such a depression occurs.

Construction and operation of conventional membrane switches is well known in the art, and is described in U.S. Pat. No. 3,522,664 to Lambright et al. Other voltage monitoring methods may be used to obtain similar results.

In addition to the above-described analog membrane switches, other configurations of membrane switches are well-known, such as four-wire digital membrane switches, three-wire membrane switches, and five-wire digital membrane switches. The main difference between these various versions are the number, configuration, and placement of the electrodes, as well as the monitoring methods and specificity of the coordinate measurements obtained. For any of these types, each membrane layer within the switch is subjected to at least the sequence of steps described above: etching to remove portions of the semiconductive coating; application of electrode strips; application of dielectric shield layers; and cutting to shape.

Each of these process steps requires handling of the unassembled top and bottom membranes, resulting in the potential for scratching or otherwise producing a defect in the semiconductive coating on the membranes. Any defects in the conductive coating results in a local variation in the resistive properties and inaccuracy in the coordinates location obtained. This problem is particularly pronounced for analog membrane switches, since analog switches are dependent on the linearity of the resistive semiconductive coatings to achieve high resolution. Thus, one small scratch or other defect on one of the membranes results in rejection of the membrane switch assembly. This problem is particularly pronounced for analog membrane switches due to the high resolution otherwise obtainable by such a switch. Conventional fabrication techniques result in on the order of a 50% rejection rate of analog membrane switches due to the high number of handling steps each membrane layer is exposed to, thus effectively doubling the cost of each membrane switch.

SUMMARY OF THE INVENTION

In order to overcome the above-noted production failure rates, the present invention provides a membrane switch, and method for producing the same, which greatly reduces the amount of handling of each membrane layer. The membrane switch comprises a flexible first substrate having a first electrically conductive surface; a second substrate having a second electrically conductive surface; and a dielectric intermediate substrate having third and fourth opposite surfaces and defining a central aperture. One or more first electrodes are formed on the third surface on the intermediate substrate, and one or more second electrodes are formed on the fourth surface of the intermediate substrate. The intermediate substrate is secured between the first surface of the first substrate and the second surface of the second substrate, such that the first and second electrodes are in electrical contact with the first and second surfaces, respectively. The first substrate is depressible through the central aperture of the intermediate substrate to contact the second substrate.

In a further aspect of the present invention, the intermediate substrate comprises an intermediate circuit spacer. The intermediate circuit spacer includes a peripheral frame portion circumscribing the central aperture and a tail portion projecting from one side of the frame portion, away from the central aperture. At least two x-axis electrodes are formed on a third surface of the frame portion on opposing sides of the central aperture. At least two y-axis electrodes are formed on the fourth surface of the spacer on opposing sides of the central aperture, and are disposed perpendicular to the x-axis electrodes.

In a still further aspect of the present invention, each of the y- and x-axis electrodes includes a contact portion formed on the frame portion of the spacer for contacting the corresponding first or second surface of the first or second substrates. Each electrode further includes a lead portion extending from the frame portion of the spacer to the tail portion of the spacer. A dielectric material layer is applied to the third and fourth surfaces of the intermediate circuit spacer to cover the lead portions of the x- and y-axis electrodes, while leaving the contact portions of the electrodes exposed.

In a still further aspect of the present invention, the intermediate circuit spacer is secured between the first and second substrates by the use of a conductive adhesive. In a preferred embodiment, the conductive adhesive is electrically conductive only in the z-axis direction, orthogonal to the intermediate circuit membrane x- and y-axis electrodes.

In yet a further aspect of the present invention, z-axis electrically conductive adhesive is applied only on the sections of the intermediate circuit spacer on which exposed contact portions of the electrodes are located, and a less costly, nonconductive adhesive is applied on the remainder.

The matrix switch of the present invention, and method for producing the same, results in a significant decrease in the production failure rate. Many of the processing steps previously performed on the semiconductive coated membrane layers of conventional membrane switches are instead performed on the intermediate circuit frame. Thus, the first and second substrates with their conductive surfaces are handled only to cut them to shape. Additionally, an array of dielectric projections may be applied to one of the substrates, after which no further processing prior to assembly is required. No etching, application of electrodes, or dielectric coating of lead portions of the electrodes is done to these substrates, thus eliminating these opportunities for scratching or marring the fragile conductive coating formed thereon.

BRIEF DESCRIPTION OF THE DRAWINGS

The foregoing aspects and many of the attendant advantages of the present invention will become more readily appreciated by reference to the following detailed description, when taken in conjunction with the accompanying drawings, wherein.

DETAILED DESCRIPTION OF THE PREFERRED EMBODIMENTS

Figure 1:
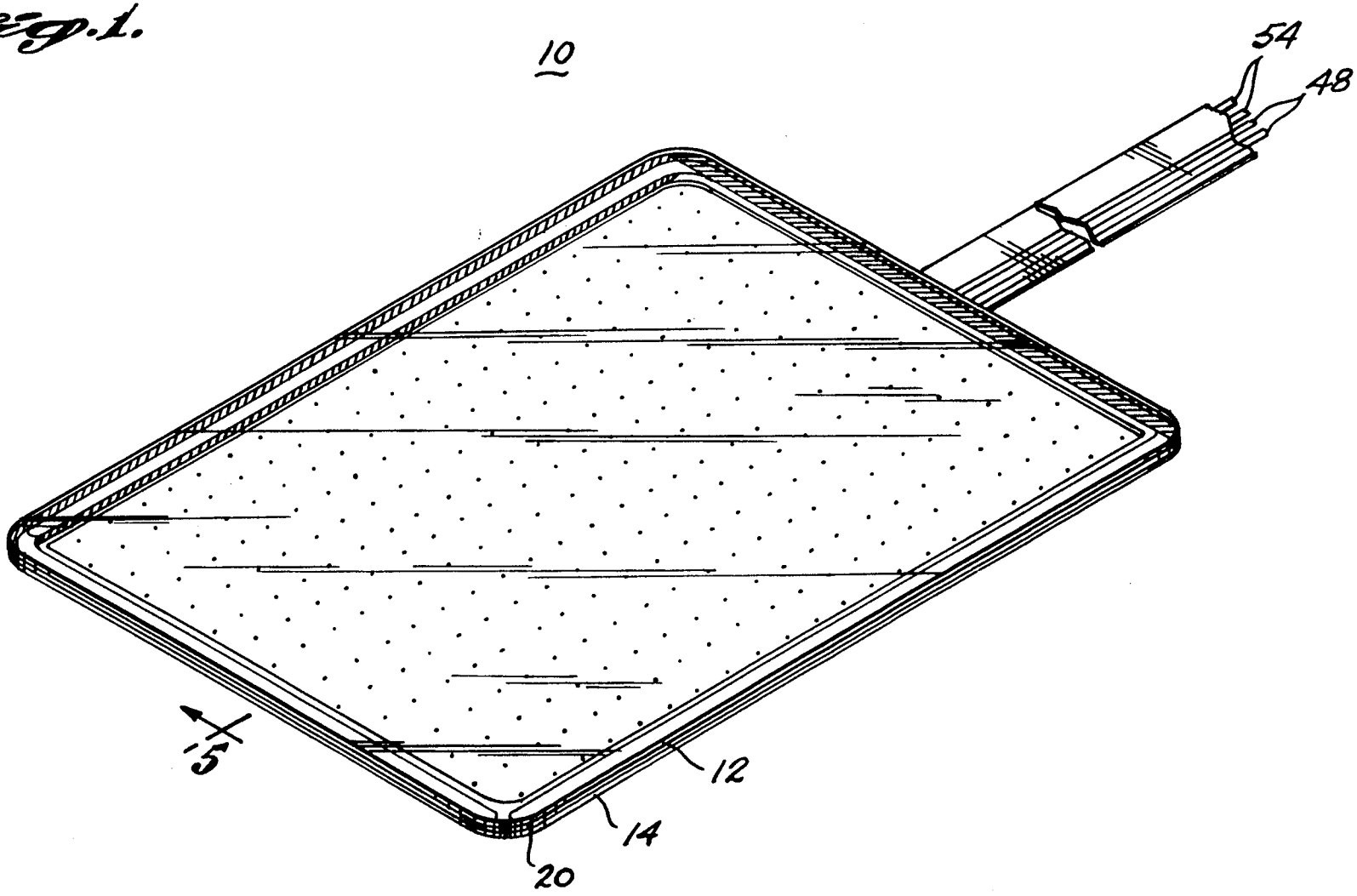
FIG. 1 provides a pictorial view of an analog membrane switch constructed in accordance with the present invention.
Figure 2:
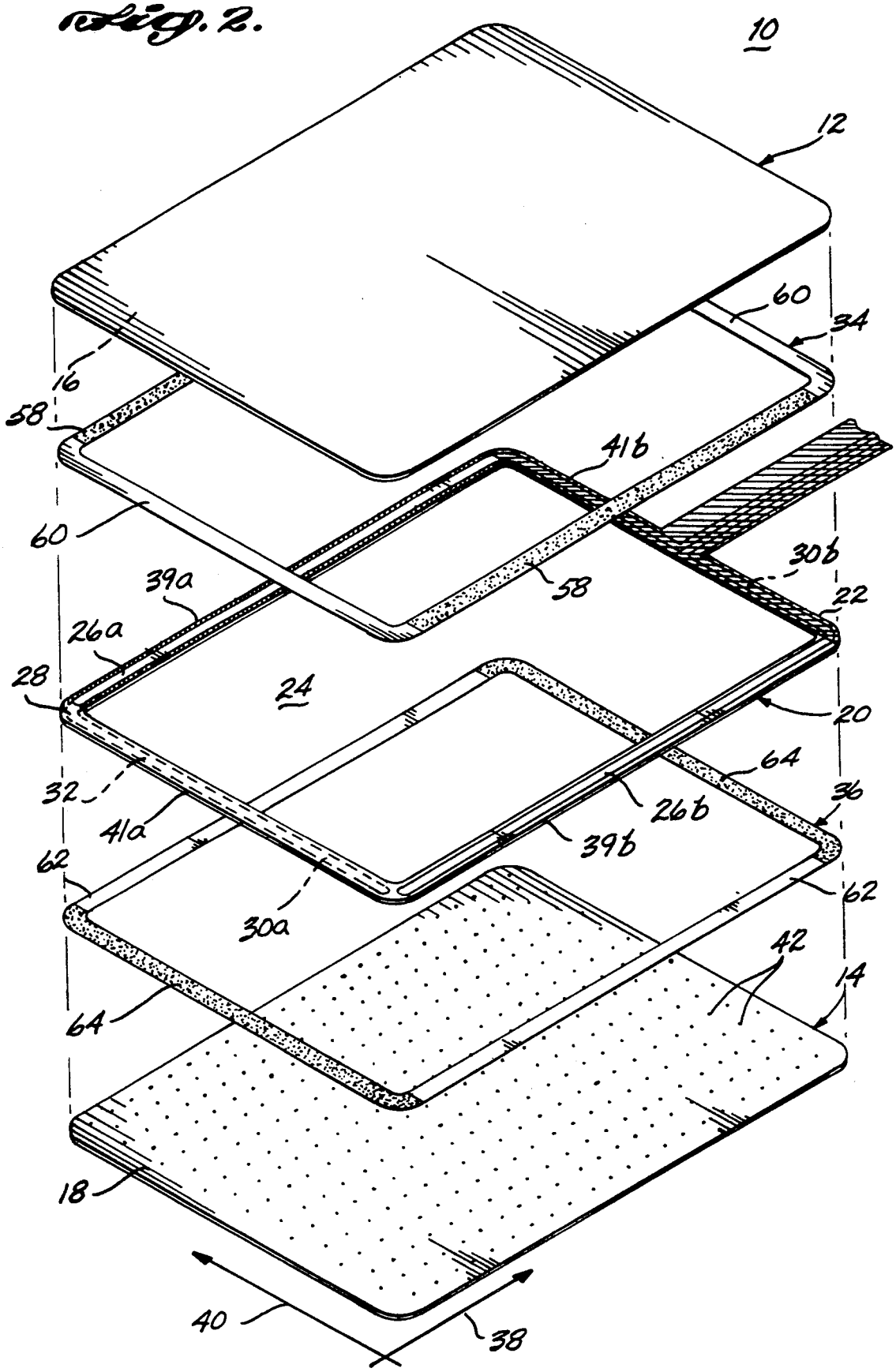
FIG. 2 provides an exploded view of the analog membrane switch of FIG. 1.

Referring first to FIGS. 1 and 2, an analog membrane switch 10 is shown, such as would be used for a touch screen. The membrane switch 10 includes a first flexible substrate, such as a top membrane 12, and a second substrate, such as a bottom membrane 14. A first, lower surface 16 of the top membrane 12 and a second, upper surface 18 of the bottom membrane 14 are conductive. An intermediate substrate, such as a peripheral intermediate circuit spacer 20, is disposed between the top and bottom membranes 12 and 14. The intermediate circuit membrane 20 has a frame portion 22 circumscribing a large rectangular central aperture 24.

Two y-axis electrodes **26*a* and 26*b* are formed on a third, upper surface 28 of the intermediate circuit spacer 20. Two x-axis electrodes 30*a* and 30*b* are formed on an opposite fourth, lower surface 32 of the intermediate circuit spacer 20. Upper and lower adhesive layers 34 and 36 are applied above and below the intermediate circuit spacer 20 to secure the top membrane 12, intermediate circuit spacer 20, and bottom membrane 14 together. The portions of the adhesive layers 34 and 36 directly overlying the electrodes 26*a* and 26*b*, and 30*a* and 30*b* are electrically conductive so as to permit electrical contact between the electrodes and the corresponding opposing surfaces of the top membrane 12 and the bottom membrane 14**.

As used herein, the flexible first substrate is referred to as the "top" membrane 12, while the second substrate is described as the "bottom" membrane 14, with descriptions of upper and lower surfaces corresponding to these labels. However, no limitation is implied by this, and it should be understood that the membrane switch 10 of the present invention can be disposed in any fashion, such as standing upright on one side. Additionally, the membrane switch 10 is described and illustrated as being rectangular in configuration with a horizontal x-axis and a vertical y-axis. However, membrane switches can be constructed in accordance with the present invention with other configurations, such as squares, or curvilinear shapes. Also, the membrane switch may have a non-planar configuration.

Referring to the preferred embodiment of a membrane switch 10 shown in FIG. 2, the y-axis electrodes 26*a* and 26*b* are formed on the long sides 39*a* and 39*b* of the intermediate circuit spacer 20. The y-axis electrodes are used to determine coordinates in the vertical, or y-axis 40, direction. The x-axis electrodes 30*a* and 30*b* are formed on the short sides 41*a* and 41*b* of the intermediate circuit spacer 20, and are used to determine the horizontal, or x-axis 38, coordinates. The z-axis (not shown) direction is disposed orthogonally to the x- and y-axes 40 and 38. Again, these denotations of the x-, y- and z-axes are provided for illustrative purposes only, and the membrane switch 10 can be disposed in other orientations.

Attention is now directed to FIG. 2 to describe the construction of the top and bottom membranes 12 and 14. The top membrane 12 is preferably constructed from a flexible, pliable dielectric material, such as a polyester plastic film. The bottom membrane 14 may be constructed from any dielectric material, and need not be flexible. Thus, rigid sheets of plastic or glass can be utilized. However, preferably a second sheet of plastic film of the same type as the top membrane 12 is utilized. If stiffening is desired, the bottom membrane 14 may be adhered to a rigid backing plate after assembly of the membrane switch 10. The lower surface 16 of the top membrane 12 and upper surface 18 of the bottom membrane 14 are each preferably coated with a semiconductive, resistive material, such as indium tin oxide ("ITO"). However, other conductive coatings can be utilized, such as gold.

To form the top and bottom membranes 12 and 14, each membrane may be stamped or die-cut from a larger sheet of the conductive-coated dielectric material. At this point, the upper membrane 12 need not be handled further until final assembly. An array of spaced-apart raised dielectric projections 42 is preferably deposited on the upper surface 18 of the bottom membrane 14 using conventional techniques. A suitable dielectric material for forming the projections is an acrylic polymer. The bottom membrane 14 then need not be handled further until assembly of the membrane switch 10.

Figure 3:
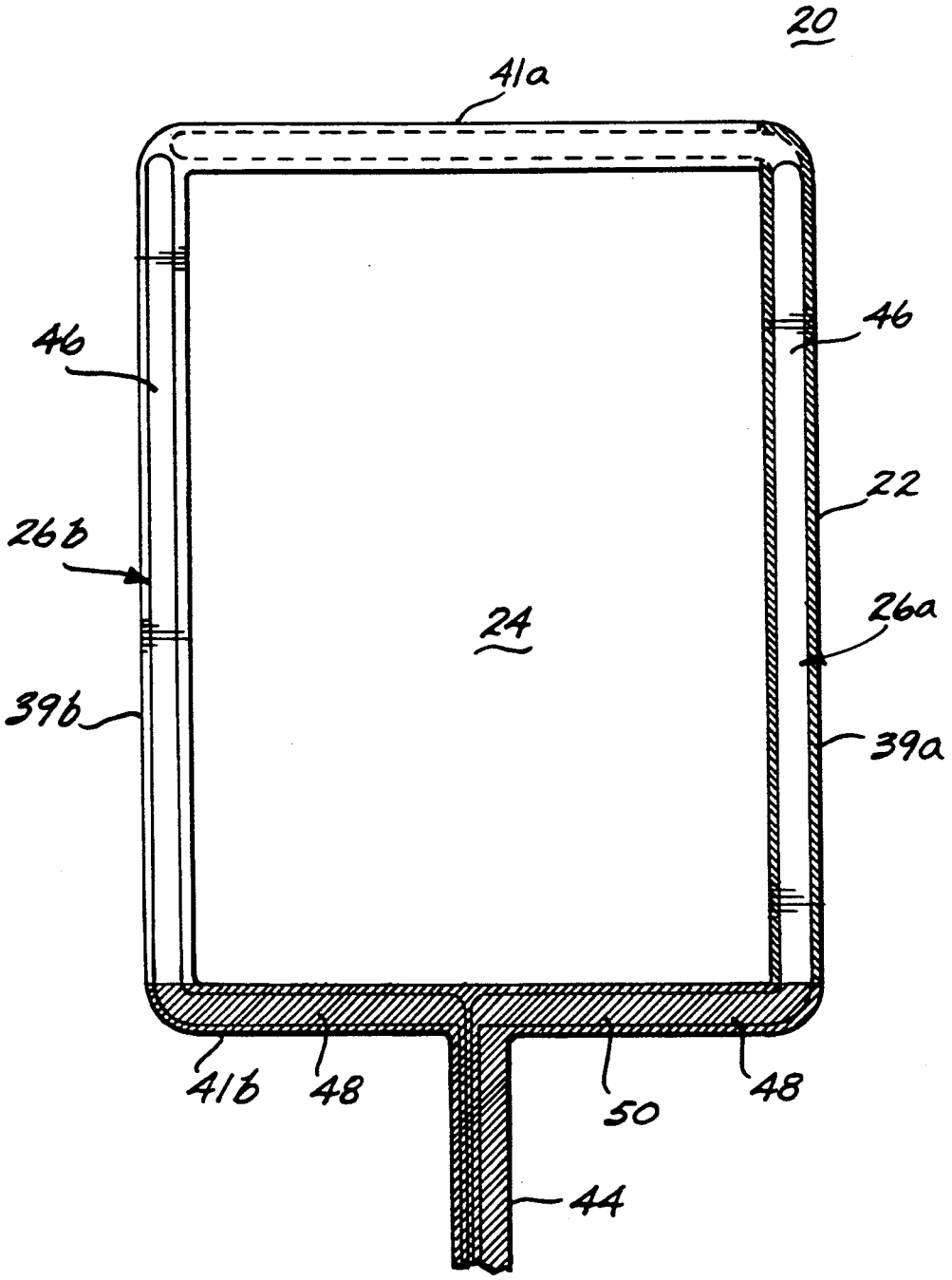
FIGS. 3 and 4 provide top and bottom plan views, respectively, of the intermediate circuit spacer used in the analog membrane switch of FIG. 1.
Figure 4:
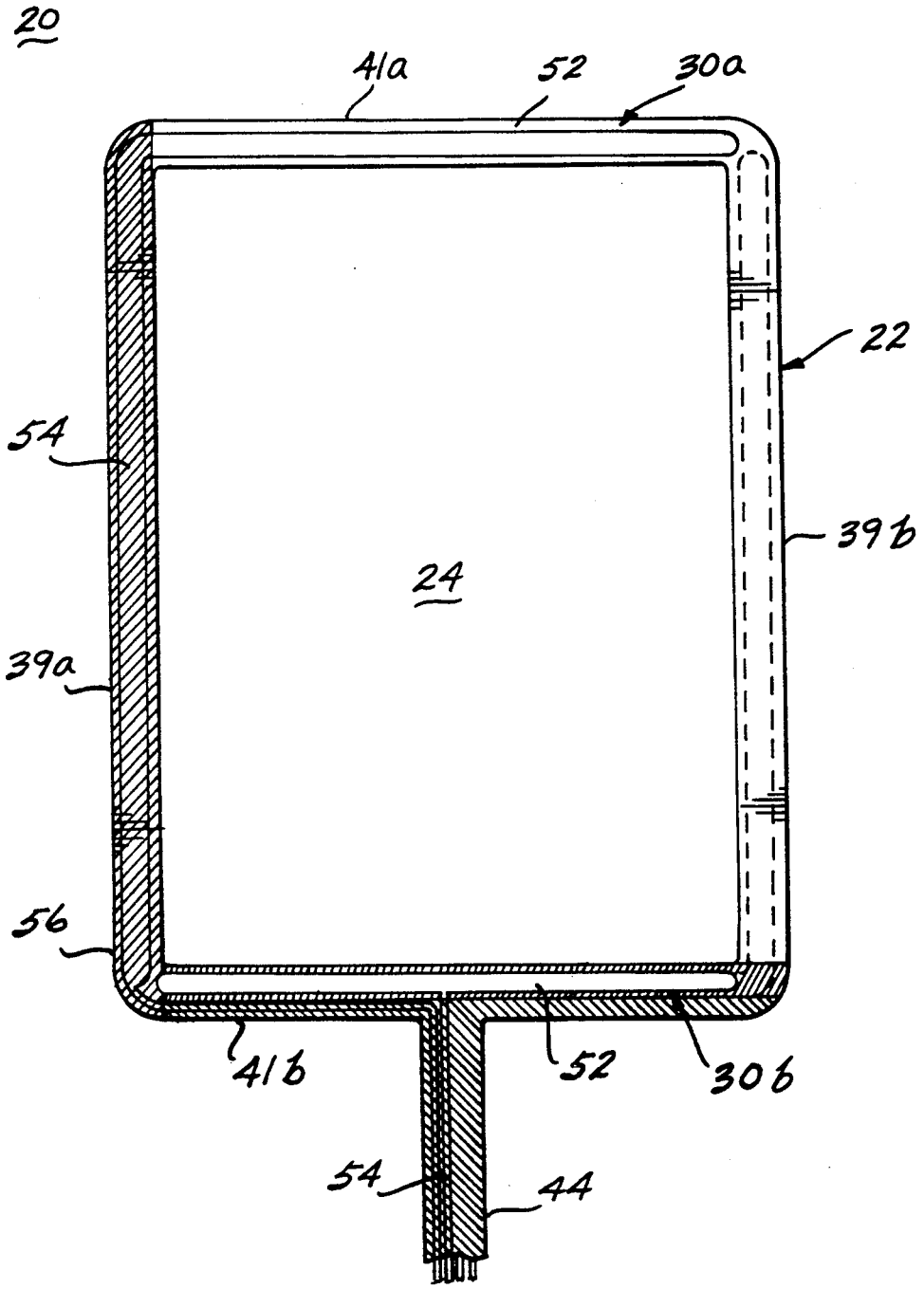

Referring now to FIGS. 3 and 4, top plan and bottom plan views of the intermediate circuit spacer 20 are shown. The frame portion 22 comprises a narrow border that circumscribes the central aperture 24. In addition to the rectangular frame portion 22, the intermediate circuit spacer 20 includes a tail portion 44 extending from one side of the frame portion 22 and projecting away from the central aperture 24. In the preferred embodiment illustrated, the tail portion 44 extends outwardly from the center of the short side 41*b* of the frame portion 22, away from the central aperture 24. The tail portion 44 provides a path for the electrodes 26*a*, and 30*a*, to extend from the intermediate circuit spacer 20 for connection to external circuitry. While in the preferred embodiment illustrated one tail portion 44 is provided, it should be apparent that other numbers and placements of tails would be possible. Thus, for example, two opposing tails can be provided with one tail carrying the x-axis electrode leads, and the other carrying the y-axis electrode leads.

The intermediate circuit spacer 20 is preferably constructed from a polyester dielectric film. This dielectric film may be the same as used to construct the top and bottom membranes 12 and 14, except that no conductive coating is present. One grade of polyester film found to be suitable is available commercially under trade name MELINEX ST 504 from ICI Films, Wilmington, Del. Other dielectric polymer films can also be utilized.

Referring first to the embodiment illustrated in FIG. 3, the y-axis electrodes 26*a* and 26*b* comprise elongate strips of conductive material. Preferably, the electrodes are formed on the intermediate circuit spacer 20 by silk-screening a conductive ink, such as a silver based ink. However, it should be readily apparent that the electrodes could be applied by other conventional methods, e.g., by adhering copper strips onto the underlying spacer 20.

Each y-axis electrode 26*a* and 26*b* includes a contact portion 46 disposed along the long sides 39*a* and 39*b* of the frame portion 22 of the intermediate circuit spacer 20. Thus, the contact portions 46 are disposed parallel to each other. In order to provide for an electrical connection between these contact portions 46 and external circuitry, each electrode 26*a* and 26*b* further includes an electrically conductive lead portion 48 that extends from one end of the contact portion 46, halfway across the short side 41*b* of the frame portion 22 of the intermediate circuit spacer 20, and longitudinally along the tail portion 44 of the intermediate circuit spacer 20. Referring to FIG. 1, the terminal ends of the lead portions 48 extend to the projecting end of the tail portion 44 of the intermediate circuit spacer 20. The contact portions 46 and lead portions 48 of each y-axis electrode 26 form a continuous strip and are applied to the intermediate circuit spacer 20 at the same time. The different portions 46 and 48 are referred to only for the purposes of understanding the function and treatment of the electrodes.

Referring again to FIG. 3, it is desired to have only the contact portions 46 of the y-axis electrodes 26*a* and 26*b* exposed for electrical contact with the corresponding lower surface 16 of the top membrane 12. Thus, a layer 50 of a dielectric material is applied to the intermediate circuit spacer 20 to cover the lead portion 48 of the y-axis electrodes 26*a* and 26*b*. The dielectric layer 50 covers the upper surface of one of the short side 41*b* of the frame portion 22 and the tail portion 44 of the intermediate circuit spacer 20. The dielectric material used to form the dielectric layer 50 may be the same material used to form the dielectric projections 42 (FIG. 2) on the upper surface 18 of the bottom membrane 14, such as an acrylic plastic. This dielectric layer may be screen printed onto the intermediate circuit spacer 20. Alternatively, a separate film of dielectric material, such as a polyester, may be bonded to the intermediate circuit spacer 20 over the lead portions 48 of the electrodes, by heat bonding or adhesion.

Referring to FIG. 4, the x-axis electrodes 30*a* and 30*b* are formed on the intermediate circuit spacer 20 in the same manner. Each x-axis electrode 30*a* and 30*b* has a contact portion 52 and a lead portion 54. Again, these portions 52 and 54 are applied at the same time, and form continuous electrode strips. The contact portion 52 of the first x-axis electrode 30*a* extends along the length of the short side 41*a* of the frame portion 22 of the intermediate circuit spacer 20. The lead portion 54 of the x-axis electrode 30*a* extends from one end of the contact portion 52, down along the long side 39*a* of the frame portion 22, across half of the other short side 41*b* of the frame portion 22, and across the tail portion 44 of the intermediate circuit spacer 20.

In the illustrated embodiment, the second x-axis electrode 30*b* is formed in a general "T" shaped configuration, and includes a contact portion 52 that extends along the length of the short side 41*b* of the frame portion 22. The lead portion 54 of the second x-axis electrode 30*b* extends from a central point along the length of the contact portion 52, and across the tail portion 44 of the intermediate circuit spacer 20.

A dielectric layer 56 is applied over the first long side 39*a* of the frame portion 22 and one edge of the second short side 41*b* of the frame portion 22, as well as the tail portion 44, to cover the lead portions 54 of the x-axis electrodes 30*a* and 30*b*. Thus, only the contact portions 52 of the x-axis electrodes 30*a* and 30*b* are exposed on this lower surface 32 of the intermediate circuit spacer 20.

Referring again to FIGS. 2 and 5, the intermediate circuit spacer 20 is secured between the top membrane 12 and bottom membrane 14 by upper and lower adhesive layers 34 and 36. It is necessary to have electrical contact between the y-axis electrodes 26 and the top membrane 12, and the x-axis electrodes 30 and the bottom membrane 40. Thus, at least the portions of the adhesive layers 34 and 36 overlying the contact portions 46 and 52 of the electrodes 26 and 30, respectively, must be capable of electrical conduction. However, it is not necessary for the portions of the adhesive layers 34 and 36 not overlying contact portions of the electrodes to be conductive.

The upper adhesive layer 34 thus includes two long electrically conductive adhesive strips 58 corresponding to the long sides 39*a, b* of the frame portion 22 of the intermediate circuit spacer 20, and two short substantially electrically nonconductive adhesive strips 60 corresponding to the short sides 41*a, b* of the frame portion 22. The conductive adhesive strips 58 thus overlie the contact portions 46 of the y-axis electrodes 26*a* and 26*b*. Conversely, the lower adhesive layer 36 includes two long nonconductive strips 62 and two short conductive strips 64, the latter being applied over the contact portions 52 of the x-axis electrodes 30*a* and 30*b*. The use of nonconductive adhesive is preferred for adhering non-contact portions of the intermediate circuit spacer 20, in case of a flaw in the dielectric layers 50 and 56. However, z-axis conductive adhesive can be applied across the entire surfaces 28 and 32 of spacer 20, if desired.

Both the nonconductive adhesive strips 60 and 62, and the conductive adhesive strips 58 and 64, may be applied by any conventional method, such as by silk screening onto the corresponding portions of the intermediate circuit spacer 20 before assembly of the membrane switch 10. Thus, for example, a z-axis conductive adhesive can be silk screened across the entire surfaces 28 and 32 of the spaces 20.

However, in order to control placement of the adhesive, it has been found preferable to apply both the conductive and nonconductive adhesive as films sandwiched between sheets of wax-impregnated paper transfer tape. To apply the adhesive, one paper transfer tape is peeled off and the exposed adhesive is pressed onto the corresponding portion of the intermediate circuit spacer 20. The second paper transfer tape is then peeled off and the intermediate circuit membrane is joined to the corresponding top or bottom membrane 12 or 14. One suitable nonconductive adhesive for use as adhesive strips 60 and 62 has been found to be the transfer tape sold under part number SCOTCH ®467 by the 3M Company, St. Paul, Minn.

The conductive adhesive used for adhesive strips 58 and 64 may be carbonor metal-filled and can be electrically conductive along all axes. However, it has been found most preferable to use a conductive adhesive which is electrically conductive substantially only along the z-axis, i.e., through the thickness of the adhesive. Thus, the conductive adhesive strips 58 and 64 are preferably conductive only in the direction orthogonal to the plane of the intermediate circuit spacer 20, i.e., orthogonal to the x-axis 38 and y-axis 40. A suitable z-axis conductive adhesive is disclosed by U.S. Pat. No. 4,548,862, and is commercially available under part number SCOTCH ®9703 from the 3M Company, St. Paul, Minn.

The z-axis conductive adhesive has the benefit of preventing failure of a membrane switch 10 due to any misplacement of the conductive adhesive portions on the intermediate circuit spacer 20. Thus, any portions of the conductive adhesive strips 58 and 64 which extend beyond the contact portions of the corresponding electrodes 26 and 30 do not change the performance characteristics of the membrane switch 10.

To assist in proper placement of the various layers on the intermediate circuit spacer 20, the preferred method of fabrication of the intermediate circuit spacer 20 is to apply the various layers prior to cutting the intermediate circuit spacer 20 from a sheet of stock material. Thus, the y- and x- axes electrodes 26 and 30 are first applied, followed by application of the dielectric layers 50 and 56. The adhesive layers 58, 60, 62, and 64 are then applied, with the outer protective paper transfer tape retained thereon. The intermediate circuit spacer 20 is then cut from the stock material, such as by die stamping, to form the frame portion 22, central aperture 24, and tail portion 44. The outer sheets of paper transfer tape can then be removed from the adhesive layers, and the intermediate circuit spacer 20 can be secured between the top membrane 12 and bottom membrane 14.

Figure 5:
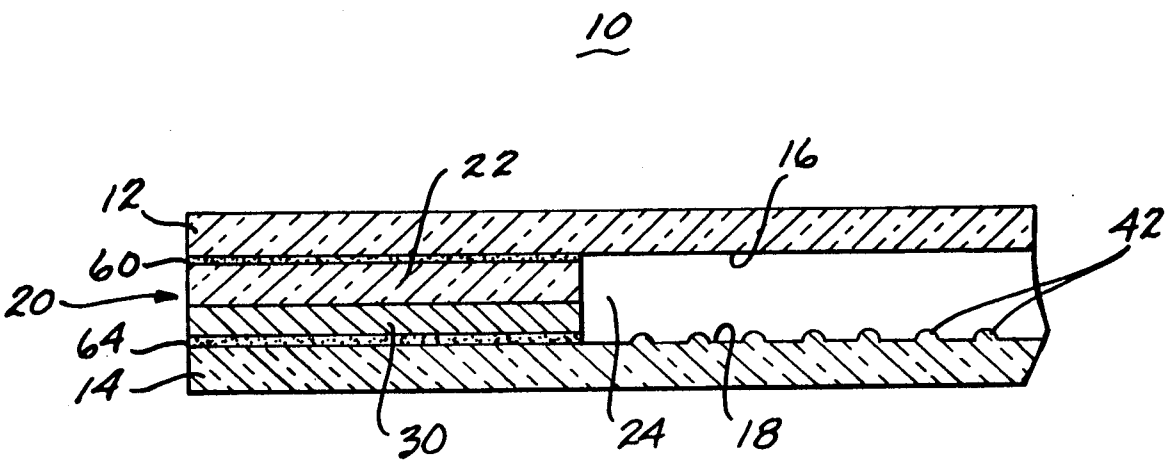
FIG. 5 provides a greatly enlarged partial cross-sectional view of the edge of an analog membrane switch taken substantially as indicated by section line 5 in FIG. 1.

FIG. 5 shows an illustrative cross section of the short side 41*a* of the assembled membrane switch 10. The thickness of the intermediate circuit spacer 20 assists in nominally separating the top membrane 12 and the bottom membrane 14. The raised dielectric projections 42 further prevent the surfaces 16 and 18 of the top and bottom membranes 12 and 14, respectively, from contacting each other through the aperture 24 of the intermediate circuit spacer 20. The top membrane 12 can be depressed through the central aperture 24 of the intermediate circuit spacer 20 to contact the bottom membrane 14 during operation of the membrane switch 10.

Although the present invention has been shown and described above for construction of a four-wire analog membrane switch, it should be apparent that the present invention is also well suited for the construction of other types of analog membrane switches, such as three-wire switches and five-wire switches.

Figure 6:
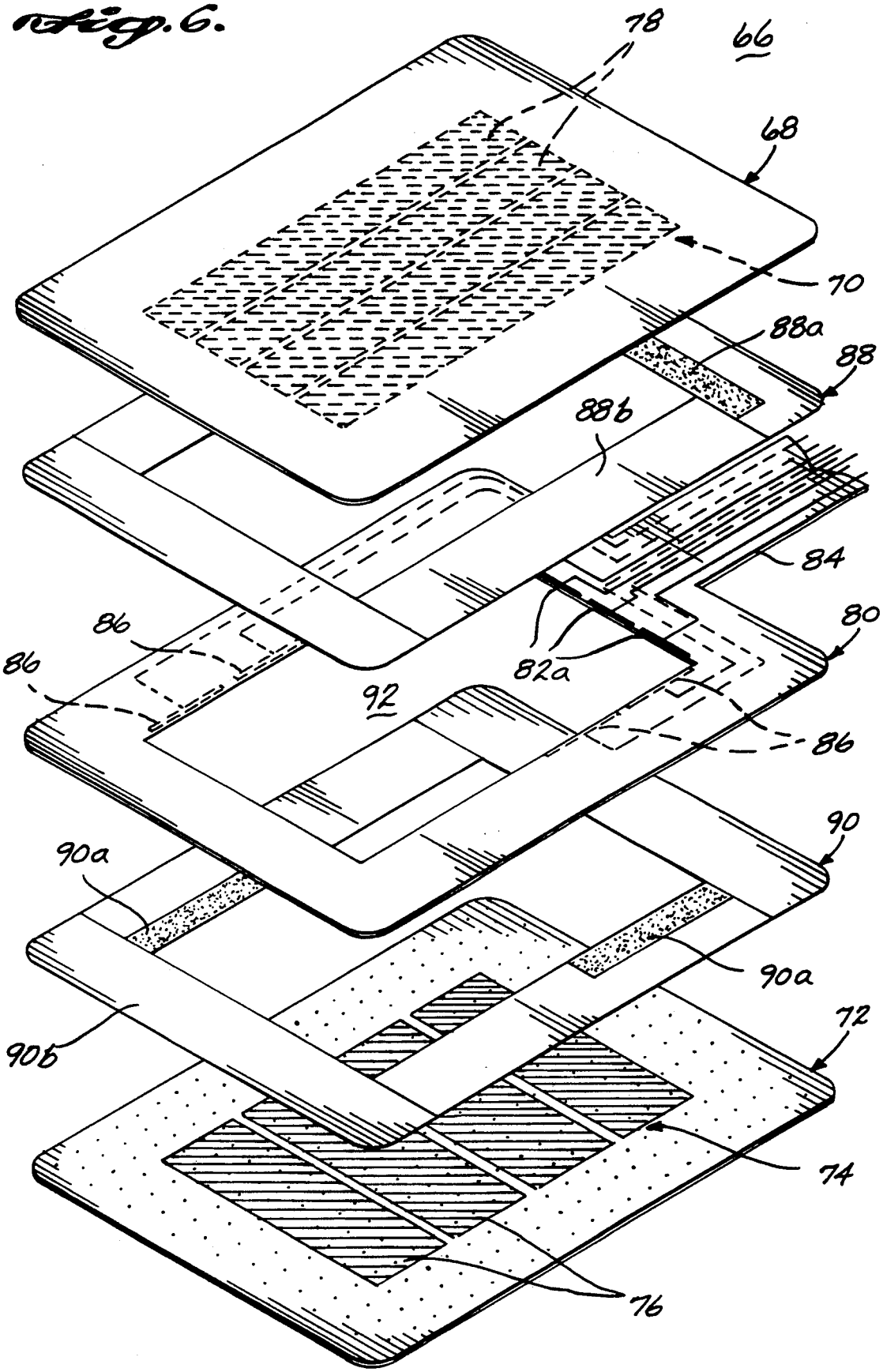
FIG. 6 provides an exploded view of an alternate embodiment of a digital membrane switch constructed in accordance with the present invention.

In addition to analog membrane switches, the present invention may also be used to construct digital membrane switches. A digital membrane switch 66 constructed in accordance with the present invention is illustrated in FIG. 6. Digital membrane switches are not so dependent on their linearity characteristics as are analog switches, thus, problems caused by surface defects in the membrane conductive coatings are not as critical as for analog switches. Nonetheless, the present invention is well suited for use in digital switches, and use of the present invention will afford an increase in production efficiency.

The digital membrane switch 66 illustrated in FIG. 6 is similarly constructed in many respects to the previously described analog membrane switch 10. Thus, those aspects which are the same will not be described in great detail. The digital membrane switch 66 includes a top membrane 68 having a lower, conductive-coated surface 70, and a bottom membrane 72 having a top conductive-coated surface 74. The conductive coating on the top surface 74 of the bottom membrane 72 is etched using conventional techniques to form a series of short parallel conductive strips 76. The bottom conductive surface 70 of the top membrane 66 is similarly etched to form a corresponding number of long parallel conductive strips 78 that are disposed perpendicularly to the short conductive strips 76. When the top membrane 68 overlies the bottom membrane 72, the conductive strips 78 and 74 cross to form a matrix of overlapping conductive squares that can be used to locate a position on the membrane switch corresponding to a particular matrix location.

An intermediate circuit spacer 80 is secured between the top membrane 68 and the bottom membrane 72. A plurality of x-axis electrodes 82 are formed on the upper surface of the intermediate circuit spacer 80, with one electrode 82 corresponding to each of the long conductive strips 78. Each x-axis electrode 82 has a contact bar portion which corresponds to the width of one of the conductive strips 78 and a lead portion that extends from the contact bar portion, across a tail 84 of the intermediate circuit spacer 80. Correspondingly, on the opposite lower side of the intermediate circuit spacer 80, a plurality of y-axis electrodes 86 are formed. Each electrode 86 corresponds to one of the short conductive strips 76 on the bottom membrane 72. Again, each y-axis electrode 86 includes a contact bar portion and a lead portion extending over the tail 84.

The arrangement of the conductive strips and electrodes of the digital membrane switch 66 is well known in the art, and is the same as that for conventionally constructed digital membrane switches. However, in contrast to conventional digital membrane switches, the electrodes 82 and 86 are formed on the intermediate circuit spacer 80, rather than on the top and bottom membranes. Additionally, a conventional digital membrane switch would have a layer of dielectric material placed over each of the top and bottom membrane electrodes to prevent contact of the electrodes with the opposite membrane. This dielectric layer is not necessary in the digital membrane switch 66 of the present invention, as the dielectric properties of the intermediate spacer 80 eliminate the need for such layers.

As in the previously described analog membrane switch 10, the layers of the digital membrane switch 66 are assembled with a first adhesive layer 88 and a second adhesive layer 90 placed on the upper and lower surfaces, respectively, of the intermediate membrane switch 80. The upper adhesive layer 88 preferably includes a z-axis electrically conductive portion **88*a*, which is adhered over the x-axis electrodes 82, and a nonconductive portion 88*b* to form the remainder of the adhesive layer 88**.

Correspondingly, the lower adhesive layer 90 includes two conductive adhesive portions **90*a* which cover and are adhered to the y-axis electrodes 86 on the underside of the intermediate circuit layer 80, with the balance of the lower adhesive layer 90 being formed from a nonconductive adhesive portion 90*b***.

Just as described previously for the analog membrane switch 10, it is most preferable to apply the x-axis and y-axis leads and the adhesive layers to the intermediate circuit spacer 80 prior to cutting the intermediate circuit spacer 80 to form a central aperture 92 therein.

The digital membrane switch 66 is illustrated as having four long conductive strips 78 and four short conductive strips 76. However, it should be readily apparent that larger or smaller digital membrane switches with greater or fewer conductive strips can also be advantageously produced with the present invention.

The present invention has been described in relation to several preferred embodiments. One of ordinary skill, after reading the foregoing specification, may be able to effect various additional changes, alterations, and substitutions of equivalents without departing from the broad concepts disclosed. It is therefore intended that the scope of letters patent granted hereon be limited only by the definitions contained in the appended claims and the equivalents thereof.

The embodiments of the invention in which an exclusive property or privilege is claimed are defined as follows:

1. A membrane switch comprising:

a flexible first substrate having a first electrically conductive surface;

a second substrate having a second electrically conductive surface;

a dielectric intermediate substrate defining a central aperture and third and fourth opposite surfaces, the first substrate being depressible through the central aperture of the intermediate substrate to contact the second substrate;

means for defining at least one first electrode on the third surface of the intermediate substrate and for defining at least one second electrode on the fourth surface of the intermediate substrate; and means for securing the intermediate substrate between the first surface of the first substrate and the second surface of the second substrate and for maintaining the first and second electrodes in electrical contact with the first and second surfaces, respectively.

2. The membrane switch of claim 1, wherein the means for securing comprises an adhesive applied between the intermediate substrate and the first and second substrates.

3. The membrane switch of claim 2, wherein the adhesive applied to at least a portion of the intermediate substrate is electrically conductive.

4. The membrane switch of claim 3, wherein the electrically conductive adhesive is conductive only in a direction normal to the surface of the intermediate substrate to which it is applied.

5. The membrane switch of claim 3, wherein:

the first and second electrodes each include a contact portion for electrical contact with the corresponding first and second surfaces and a lead portion; and the adhesive applied to the contact portions is electrically conductive and the adhesive applied to the lead portions is substantially non-electrically conductive.

6. The membrane switch of claim 1, wherein the intermediate substrate includes a frame portion circumscribing the central aperture and a tail portion extending from the frame portion away from the central aperture.

7. The membrane switch of claim 6, wherein the first and second electrodes each include a contact portion, formed on the frame portion of the intermediate substrate for electrical contact with the corresponding first and second surfaces, and a lead portion, extending from the frame portion of the intermediate substrate to the tail portion of the intermediate substrate.

8. The membrane switch of claim 7, further comprising a layer of dielectric material formed over the lead portions of the first and second electrodes on the third and fourth surfaces of the intermediate substrate.

9. The membrane switch of claim 1, wherein the intermediate substrate is formed from a dielectric polymer film.

10. The membrane switch of claim 1, wherein:

the first electrodes comprise at least two opposing x-axis electrodes formed on the third surface of the intermediate substrate on opposite sides of the central aperture; and the second electrodes comprise at least two opposing y-axis electrodes formed on the fourth surface of the intermediate substrate on opposite sides of the central aperture and disposed generally perpendicular to the x-axis electrodes.

11. The membrane switch of claim 10, wherein the means for securing comprises an adhesive applied between the intermediate substrate and the first and second substrates, the adhesive being electrically conductive in the z-axis direction, orthogonal to the intermediate substrate, and substantially nonconductive in the x and y-axis directions.

12. A touch sensitive membrane switch comprising:

a flexible first membrane having a first electrically conductive coated surface;

a second substrate having a second electrically conductive coated surface;

an intermediate circuit spacer, including:

a dielectric frame defining a central aperture and third and fourth opposite surfaces, the first membrane being depressible through the central aperture of the frame to contact the second substrate;

first electrodes formed on the third surface of the frame;

second electrodes formed on the fourth surface of the frame; and means securing the intermediate circuit spacer between the first surface of the first membrane and the second surface of the second substrate such that the first and second electrodes are maintained in electrical contact with the first and second surfaces, respectively.

13. The membrane switch of claim 12, wherein the means for securing comprises an adhesive applied between the intermediate circuit spacer and the first membrane and between the intermediate circuit spacer and the second substrate.

14. The membrane switch of claim 13, wherein the adhesive applied to at least a portion of the intermediate circuit spacer is electrically conductive, the adhesive being conductive only in a direction normal to the surface of the intermediate circuit spacer to which it is applied.

15. The membrane switch of claim 12, wherein:

the dielectric frame includes a frame portion circumscribing the central aperture and a tail portion extending from the frame portion and away from the central aperture; and the first and second electrodes each include a contact portion, formed on the frame portion of the dielectric frame for electrical contact with the corresponding first and second surfaces, and a lead portion, extending from the frame portion of the dielectric frame to the tail portion of the dielectric frame.

16. The membrane switch of claim 15, further comprising a layer of dielectric material formed over the lead portions of the first and second electrodes on the third and fourth surfaces of the dielectric frame.

17. The membrane switch of claim 12, wherein:

the first electrodes comprise at least two opposing x-axis electrodes formed on the third surface of the dielectric frame on opposite sides of the central aperture;

the second electrodes comprise at least two opposing y-axis electrodes formed on the fourth surface of the dielectric frame on opposite sides of the central aperture and disposed generally perpendicular to the x-axis electrodes; and the means for securing comprises an adhesive applied between the intermediate circuit spacer and the first membrane and between the intermediate circuit spacer and the second substrate, the adhesive being electrically conductive in the z-axis direction, orthogonal to the intermediate spacer, and substantially nonconductive in the x- and y-axis directions.

* * * * *